US005951278A

United States Patent [19]

Young et al.

[11] Patent Number: 5,951,278

[45] Date of Patent: Sep. 14, 1999

[54] CANDLE HOLDER APPARATUS

[76] Inventors: April Diane Young; Scot Thomas Clark, both of 1566 Center Blvd, Springfield, Ohio 45506

[21] Appl. No.: 09/159,188

[22] Filed: Sep. 23, 1998

Related U.S. Application Data

[60] Provisional application No. 60/060,640, Oct. 1, 1997.

[51] Int. Cl.[6] ..... F23D 3/16

[52] U.S. Cl. ..... 431/291; 431/289; 362/161; D26/9

[58] Field of Search ..... 431/289, 290–297, 431/126; 362/161–163; D26/9

[56] References Cited

U.S. PATENT DOCUMENTS

| | | | |
|---|---|---|---|
| D. 369,221 | 4/1996 | Linderman . | |
| 2,050,151 | 8/1936 | Baumer | 431/291 |
| 2,315,803 | 4/1943 | Lipari | 431/291 |
| 3,501,256 | 3/1970 | Milliken . | |
| 3,741,711 | 6/1973 | Bryant . | |
| 4,017,729 | 4/1977 | Frazier, Jr. . | |
| 4,931,014 | 6/1990 | Scott et al. | 431/289 |

*Primary Examiner*—James C. Yeung

[57] ABSTRACT

A candle holder apparatus includes a translucent outer shell which includes a bottom outer shell portion and a top outer shell portion and includes a translucent inner shell which includes a bottom inner shell portion and a top inner shell portion. The inner shell defines a candle-reception chamber. A bridge is connected between the outer shell and the inner shell and provides a hollow wall space between the outer shell and the inner shell. The top outer shell portion, the top inner shell portion, and the bridge define an access opening to the candle-reception chamber. A quantity of translucent marbles are located in the hollow wall space. The inner shell is nested inside the outer shell. The outer shell is spaced from the inner shell by a substantially constant separation distance. The outer shell can be made from heat resistant tempered glass. With one class of embodiments of the invention, the bottom outer shell portion includes a flat portion for resting on a flat support surface, and the bottom inner shell portion includes a flat portion for receiving a flat bottom of a candle. With another class of embodiments, a bottom outer shell portion includes an externally threaded access neck to the hollow wall space, and the base member includes an internally threaded reception portion for receiving the hollow wall space access neck.

9 Claims, 3 Drawing Sheets

CANDLE HOLDER APPARATUS

CROSS-REFERENCE TO RELATED APPLICATION

This application claims priority based upon my prior copending Provisional application Ser. No. 60/060,640, filed Oct. 1, 1997.

BACKGROUND OF THE INVENTION

1. Field of the Invention

The present invention relates generally to candle holders and, more particularly, to candle holders especially adapted for modifying candle light with a light modifier.

2. Description of the Prior Art

To some persons, a burning candle provides an intensely bright light source. To lessen the light intensity to a viewer's eye and to provide a more diffuse, candle-based light source, a light modifier is often located between the candle flame and the eye of the viewer. Throughout the years, a number of innovations have been developed relating to diffusing the light from a candle flame, and the following U.S. patents are representative of some of those innovations: 3,501,256, 3,741,711, and 4,017,729. More specifically, U.S. Pat. No. 3,501,256 discloses a container for receiving a candle, wherein the container has single layer solid colored glass panels as walls. U.S. Pat. No. 3,741,711 discloses a candle container comprised of a single layer transparent or translucent plastic. U.S. Pat. No. 4,017,729 discloses a two-part container for a candle in which only air is located between the two parts.

To provide greater visual effects than provided by the single-layered glass-panelled or the plastic candle containers described above, it would be desirable if a candle holder had plural layers of light modifier materials. In addition, to provide greater visual effects than provided by the two-part container described above in which only air is located between the two parts, it would be desirable if a two-part candle holder included particulate, light transmitting material between the two parts.

U.S. Pat. No. Des. 369,221 may be of interest for its disclosure of a candle holder that includes a first low profile container inside a second low profile container. Because of the low profile of this candle holder, neither of the two parts provides much light modification of a candle flame.

Still other features would be desirable in a candle holder apparatus. For example, it would be desirable if a candle holder apparatus included a hollow wall space in which transparent or translucent light modifying objects could be placed. In addition, it would be desirable if a candle holder apparatus provided easy access to the hollow wall space so that transparent or translucent light modifying objects placed therein can easily be removed and replaced.

Thus, while the foregoing body of prior art indicates it to be well known to use candle holders with light modifiers, the prior art described above does not teach or suggest a light modifying candle holder apparatus which has the following combination of desirable features: (1) has plural layers of light modifier materials; (2) provides a two-part candle holder which includes particulate, light transmitting material between the two parts; (3) includes a hollow wall space in which transparent or translucent light modifying objects can be placed; and (4) provides easy access to the hollow wall space so that transparent or translucent light modifying objects placed therein can easily be removed and replaced. The foregoing desired characteristics are provided by the unique candle holder apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a candle holder apparatus which includes a translucent outer shell which includes a bottom outer shell portion and a top outer shell portion and includes a translucent inner shell which includes a bottom inner shell portion and a top inner shell portion. The inner shell defines a candle-reception chamber. A bridge is connected between the outer shell and the inner shell. The bridge provides a hollow wall space between the outer shell and the inner shell. The top outer shell portion, the top inner shell portion, and the bridge define an access opening to the candle-reception chamber. A quantity of particulate light transmitting material is located in the hollow wall space. The candle holder apparatus is a beautiful and safe holder for candle.

The particulate light transmitting material includes individual translucent discs. More specifically, the particulate light transmitting material includes individual translucent spheres such as marbles.

The outer shell can be hemispherically shaped having an outer radius of curvature, and the inner shell can be hemispherically shaped having an inner radius of curvature. The outer radius of curvature is greater than the inner radius of curvature, whereby the inner shell is nested inside the outer shell. The outer shell is spaced from the inner shell by a substantially constant separation distance. The outer shell can be made from glass. The inner shell can be made from heat resistant tempered glass.

With one class of embodiments of the invention, the bottom outer shell portion includes a flat portion for resting on a flat support surface, and the bottom inner shell portion includes a flat portion for receiving a flat bottom of a candle.

With another class of embodiments of the invention, a base member is provided for receiving the bottom outer shell portion. More specifically, the bottom outer shell portion includes an access neck to the hollow wall space, and the base member includes a reception portion for receiving the hollow wall space access neck. The hollow wall space access neck is externally threaded, and the reception portion for the hollow wall space access neck is internally threaded. With these embodiments of the invention, initial particulate light transmitting material can be removed and replaced with substitute particulate light transmitting material.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved candle holder apparatus which has all of the advantages of the prior art and none of the disadvantages.

It is another object of the present invention to provide a new and improved candle holder apparatus which may be easily and efficiently manufactured and marketed.

It is a further object of the present invention to provide a new and improved candle holder apparatus which is of durable and reliable construction.

An even further object of the present invention is to provide a new and improved candle holder apparatus which is susceptible of a low cost of manufacture with regard to both materials and labor, and which accordingly is then susceptible of low prices of sale to the consuming public, thereby making such candle holder apparatus available to the buying public.

Still yet a further object of the present invention is to provide a new and improved candle holder apparatus which has plural layers of light modifier materials.

Still another object of the present invention is to provide a new and improved candle holder apparatus that provides a two-part candle holder which includes particulate, light transmitting material between the two parts.

Yet another object of the present invention is to provide a new and improved candle holder apparatus which includes a hollow wall space in which transparent or translucent light modifying objects can be placed.

Even another object of the present invention is to provide a new and improved candle holder apparatus that provides easy access to the hollow wall space so that transparent or translucent light modifying objects placed therein can easily be removed and replaced.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved candle holder apparatus embodying the principles and concepts of the present invention will be described.

Figure 1:
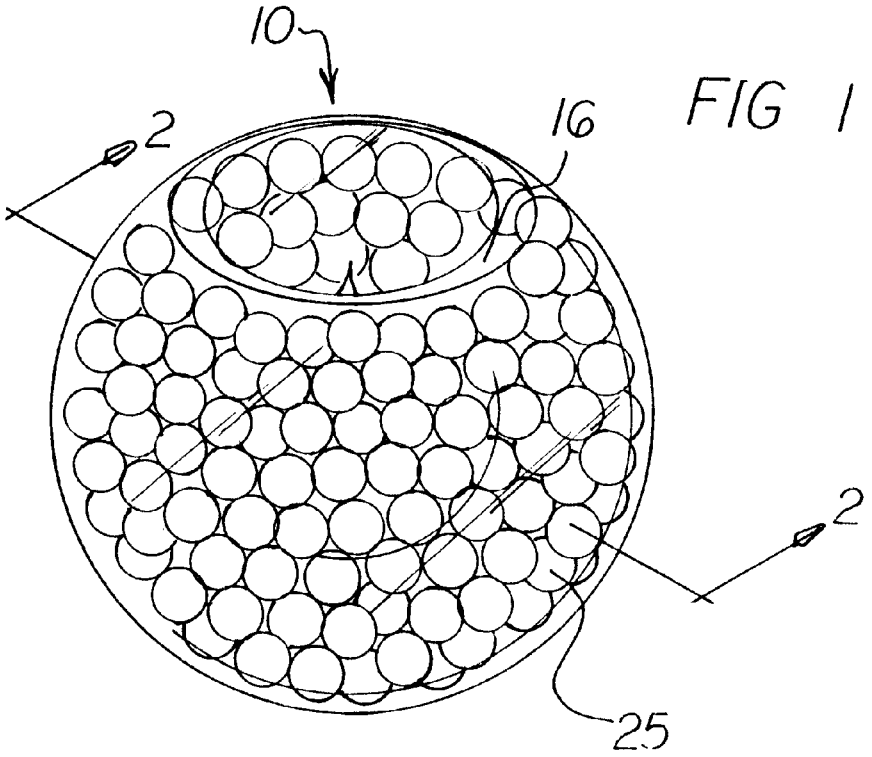
FIG. 1 is a perspective view showing a first embodiment of the candle holder apparatus of the invention.
Figure 2:
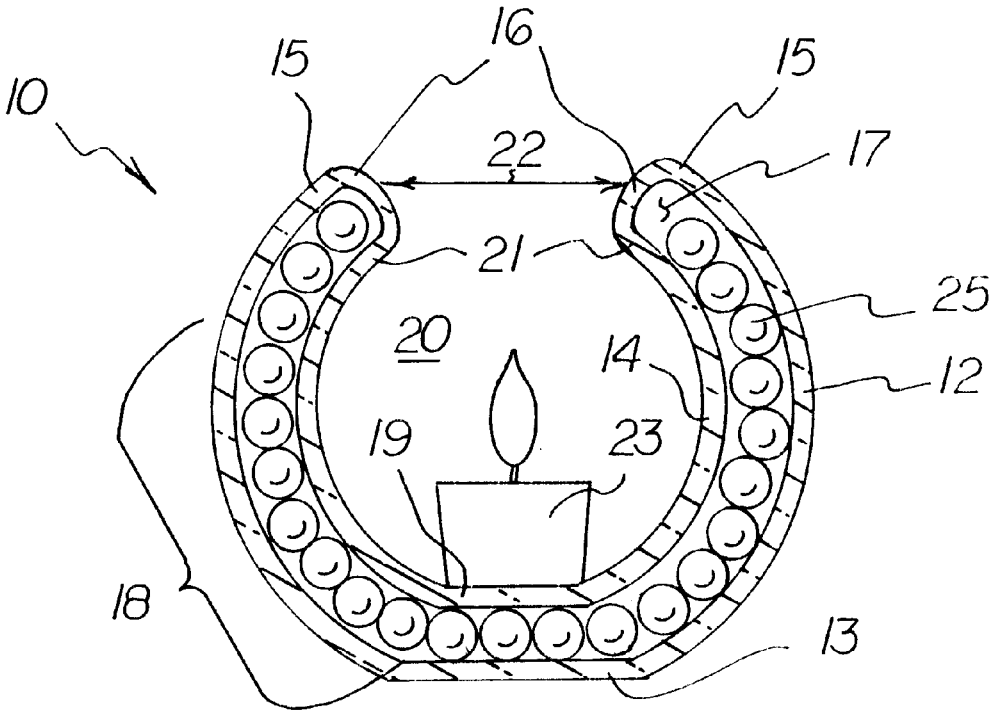
FIG. 2 is a cross-sectional view of the embodiment of the candle holder apparatus shown in FIG. 1 taken along line 2—2 of FIG. 1.

Turning to FIGS. 1–2, there is shown a first embodiment of the candle holder apparatus of the invention generally designated by reference numeral 10. The candle holder apparatus 10 includes a translucent outer shell 12 which includes a bottom outer shell portion 13 and a top outer shell portion 15 and includes a translucent inner shell 14 which includes a bottom inner shell portion 19 and a top inner shell portion 21. The inner shell 14 defines a candle-reception chamber 20. A bridge 16 is connected between the outer shell 12 and the inner shell 14. The bridge 16 provides a hollow wall space 17 between the outer shell 12 and the inner shell 14. The top outer shell portion 15, the top inner shell portion 21, and the bridge 16 define an access opening 22 to the candle-reception chamber 20. A quantity of particulate light transmitting material 18 is located in the hollow wall space 17. The candle holder apparatus 10 is a beautiful and safe holder for a candle 23.

The particulate light transmitting material 18 can include individual translucent discs. The particulate light transmitting material 18 can include individual translucent spheres 25. The individual translucent spheres 25 can be readily available marbles.

As shown in the embodiment of the invention in FIGS. 1 and 2, the outer shell 12 is hemispherically shaped and has an outer radius of curvature. The inner shell 14 is hemispherically shaped and has an inner radius of curvature. The outer radius of curvature is greater than the inner radius of curvature, whereby the inner shell 14 is nested inside the outer shell 12. The outer shell 12 is spaced from the inner shell 14 by a substantially constant separation distance 31. The outer shell 12 can be made from glass. The inner shell 14 can be made from heat resistant tempered glass.

The bottom outer shell portion 13 includes a flat portion for resting on a flat support surface, and the bottom inner shell portion 19 includes a flat portion for receiving a flat bottom of a candle 23.

To use the embodiment of the invention shown in FIGS. 1 and 2, a candle 23 is lowered into the candle-reception chamber 20 through the access opening 22. The candle 23 rests on the flat portion of the bottom inner shell portion 19. The candle 23 can bear a scent. The flat portion of the bottom outer shell portion 13 rests on a support surface (not shown) such as a table top. The candle 23 can then be lit. The flame of the candle 23 is somewhat mobile, and moving Light from the candle 23 passes through the translucent inner shell 14, the particulate light transmitting material 18, and the translucent outer shell 12 to be viewed from outside the outer shell 12. The moving light emerging from the outer shell 12 has undergone a variety of reflections and refractions to provide a shimmering glow that is very tranquil and relaxing. In addition, scent is provided by the scented candle. The candle holder apparatus 10 in conjunction with the candle 23 provide a tealight.

Figure 3:
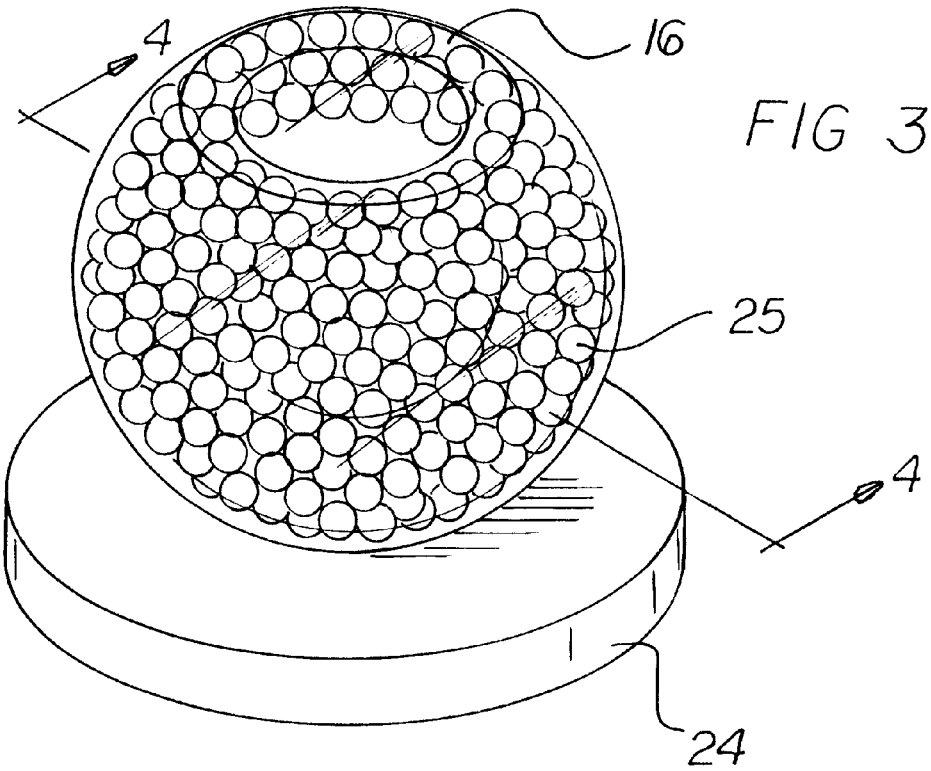
FIG. 3 is a perspective view showing a second embodiment of the candle holder apparatus of the invention.
Figure 4:
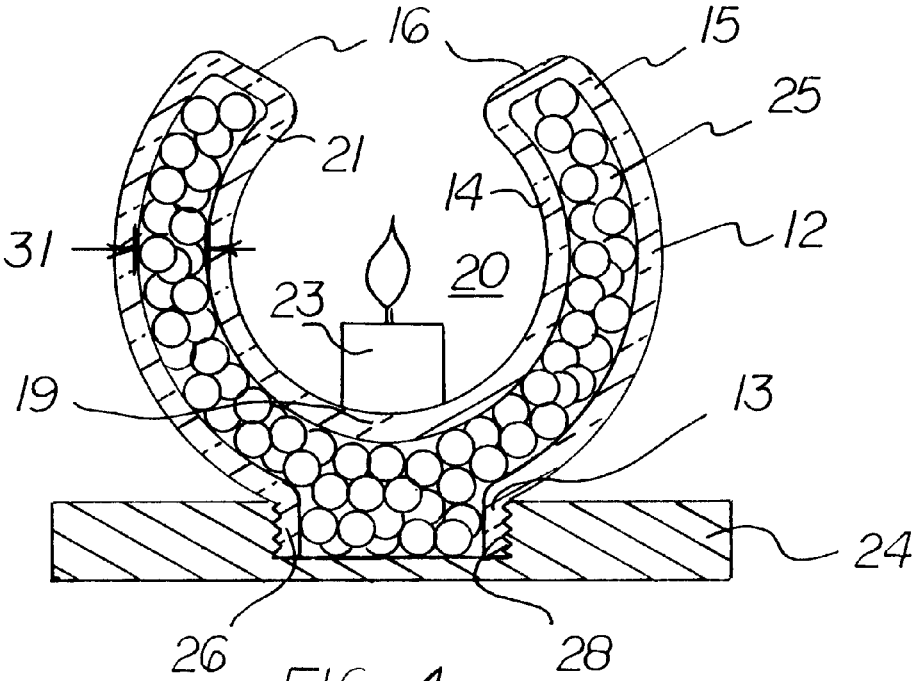
FIG. 4 is a cross-sectional view of the embodiment of the candle holder apparatus shown in FIG. 3 taken along line 4—4 of FIG. 3.
Figure 5:
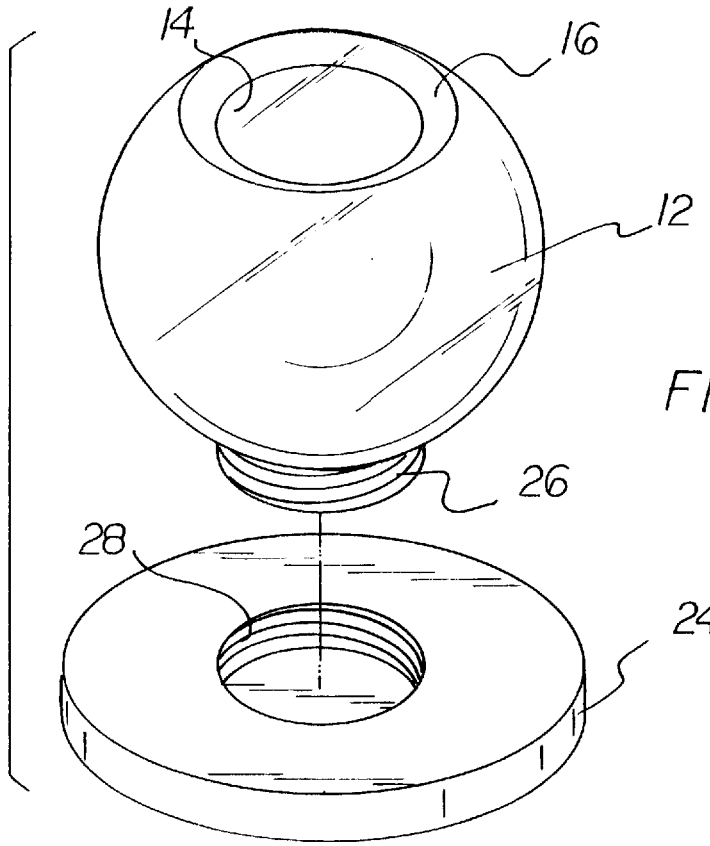
FIG. 5 is an exploded view of the embodiment of the invention shown in FIGS. 3 and 4 with the light directing particles removed therefrom.
Figure 6:
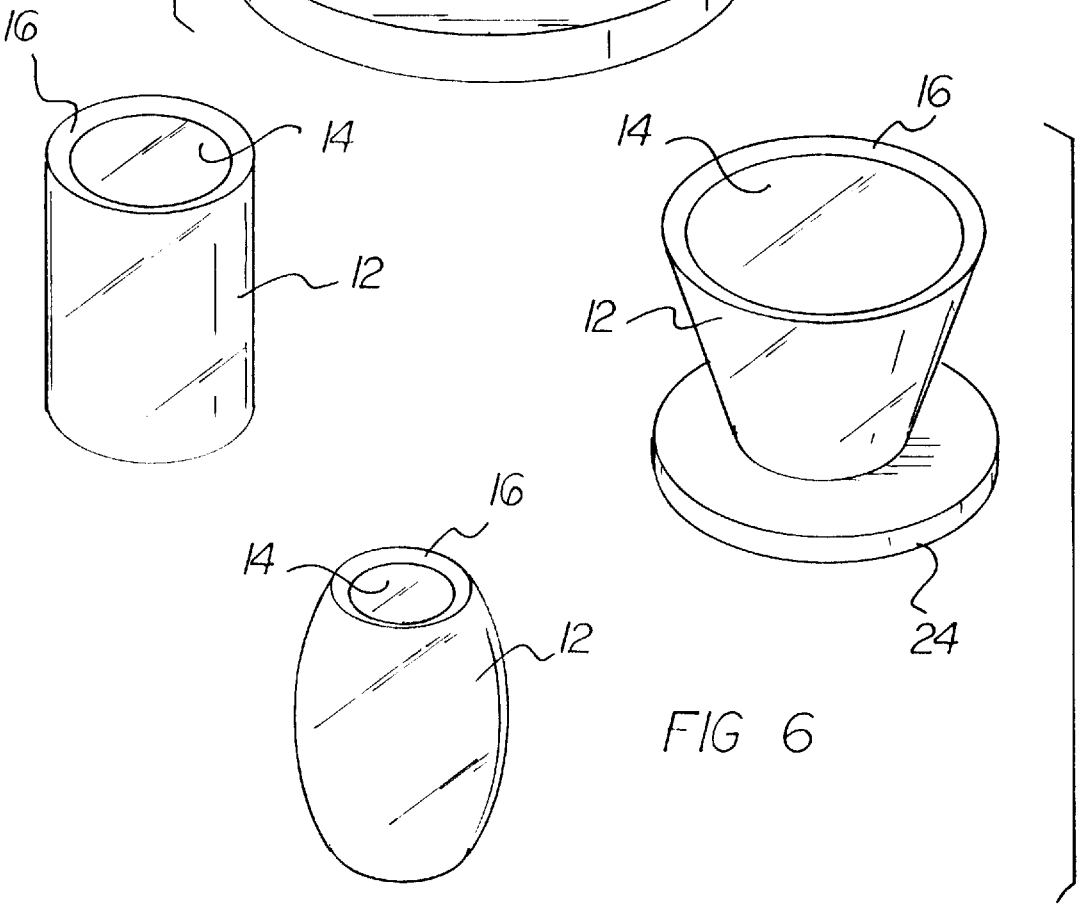
FIG. 6 shows perspective views of three additional embodiments of the candle holder apparatus of the invention.

In accordance with the embodiment of the invention shown in FIGS. 3–5, a base member 24 is provided for receiving the bottom outer shell portion 13. The bottom outer shell portion 13 includes an access neck 26 to the hollow wall space 17. The base member 24 includes a reception portion 28 for receiving the hollow wall space access neck 26. The hollow wall space access neck 26 is externally threaded, and the reception portion 28 for the hollow wall space access neck 26 is internally threaded.

To use the embodiment of the invention shown in FIGS. 3–5, the hollow wall space access neck 26 is unscrewed from the reception portion 28 of the base member 24. The particulate light transmitting material 18 can be dumped out from the hollow wall space 17 and can be replaced with substitute particulate light transmitting material 18.

With any of the embodiments of the invention, the particulate light transmitting material 18 can be a variety of colors to match home decor. In addition, the outer shell 12 and the inner shell 14 can be made in a variety of shapes and sizes. Moreover, the candle 23 can be replaced by an electrically powered lamp. Preferably, the outer shell 12 is spaced from the inner shell 14 so that the particulate light transmitting material 18 can be retained in the hollow wall space 17 in only a few layers of particulate light transmitting material 18.

The components of the candle holder apparatus of the invention can be made from inexpensive and durable glass, metal, and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved candle holder apparatus that is low in cost, relatively simple in design and operation, and which has plural layers of light modifier materials. With the invention, a candle holder apparatus provides a two-part candle holder which includes particulate, light transmitting material between the two parts. With the invention, a candle holder apparatus is provided which includes a hollow wall space in which transparent or translucent light modifying objects can be placed. With the invention, a candle holder apparatus provides easy access to the hollow wall space so that transparent or translucent light modifying objects placed therein can easily be removed and replaced.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A candle holder apparatus, comprising:

a translucent outer shell which includes a bottom outer shell portion and a top outer shell portion, a translucent inner shell which includes a bottom inner shell portion and a top inner shell portion, wherein said inner shell defines a candle-reception chamber, a bridge connected between said outer shell and said inner shell, wherein said bridge provides a hollow wall space between said outer shell and said inner shell, wherein said top outer shell portion, said top inner shell portion, and said bridge define an access opening to said candle-reception chamber, and a quantity of particulate light transmitting solid particles located in said hollow wall space, said solid particles being selected from the group comprising discs or spheres.

2. The apparatus of claim 1 wherein:

said outer shell is hemispherically shaped having an outer radius of curvature, said inner shell is hemispherically shaped having an inner radius of curvature, and said outer radius of curvature is greater than said inner radius of curvature, whereby said inner shell is nested inside said outer shell.

3. The apparatus of claim 1 wherein said outer shell is spaced from said inner shell by a substantially constant separation distance.

4. The apparatus of claim 1 wherein said outer shell can be made from glass.

5. The apparatus of claim 1 wherein said inner shell can be made from heat resistant tempered glass.

6. The apparatus of claim 1 wherein:

said bottom outer shell portion includes a flat portion for resting on a flat support surface, and said bottom inner shell portion includes a flat portion for receiving a flat bottom of a candle.

7. The apparatus of claim 1, further including:

a base member for receiving said bottom outer shell portion.

8. A candle holder apparatus, comprising:

a translucent outer shell which includes a bottom outer shell portion and a top outer shell portion, a translucent inner shell which includes a bottom inner shell portion and a top inner shell portion, wherein said inner shell defines a candle-reception chamber, a bridge connected between said outer shell and said inner shell, wherein said bridge provides a hollow wall space between said outer shell and said inner shell, wherein said top outer shell portion, said top inner shell portion, and said bridge define an access opening to said candle-reception chamber, and a quantity of particulate light transmitting material located in said hollow wall space, said apparatus further including:

a base member for receiving said bottom outer shell portion, and wherein said bottom outer shell portion includes an access neck to said hollow wall space, said base member includes a reception portion for said hollow wall space access neck.

9. The apparatus of claim 8 wherein:

said hollow wall space access neck is externally threaded, and said reception portion for said reception portion for said hollow wall space access neck is internally threaded.

* * * * *